US006530657B2

(12) United States Patent
Polierer

(10) Patent No.: US 6,530,657 B2
(45) Date of Patent: Mar. 11, 2003

(54) INK JET PRINTER WITH A PIEZO PRINTING HEAD FOR EJECTING LACTATE INK ONTO AN UNCOATED PRINTING MEDIUM

(75) Inventor: Joschy Polierer, Ismaning (DE)

(73) Assignee: TECHNOPLOT CAD Vertriebs GmbH, Ismaning (DE)

( * ) Notice: Subject to any disclaimer, the term of this patent is extended or adjusted under 35 U.S.C. 154(b) by 0 days.

(21) Appl. No.: 10/003,036

(22) Filed: Nov. 15, 2001

(65) Prior Publication Data

US 2002/0109767 A1 Aug. 15, 2002

(30) Foreign Application Priority Data

Nov. 15, 2000 (DE) ..... 100 56 703

(51) Int. Cl.[7] ..... B41J 2/01
(52) U.S. Cl. ..... 347/102
(58) Field of Search ..... 347/102, 101, 347/104, 105, 106, 107, 43, 4; 399/320; 346/25; 219/216; 101/488; 34/304, 381; 516/70; 8/471

(56) References Cited

FOREIGN PATENT DOCUMENTS

| | | |
|---|---|---|
| DE | 195 00 391 | 7/1996 |
| DE | 196 11 700 | 10/1996 |
| EP | 0 761 449 | 3/1997 |
| EP | 1 044 817 | 10/2000 |
| JP | 62144955 | 6/1987 |
| WO | WO00/24583 | 5/2000 |

*Primary Examiner*—Raquel Yvette Gordon
(74) *Attorney, Agent, or Firm*—Collard & Roe, P.C.

(57) ABSTRACT

An ink jet printer with a piezo printing head (19) ejects lactate ink onto an uncoated printing medium (16) within the area of a surface to be imprinted. A preheating area (21) for preheating the printing medium (16) from its side opposing the piezo printing head is connected upstream of the surface to be imprinted, whereby the preheating area (21) can be adjusted to a temperature from 24° C. to 50° C. depending on the type of material and its thickness and/or the transport speed of the printing medium (16). There is an after-heating area (22) for drying the lactate ink applied to the printing medium (16) connected downstream of the surface to be imprinted from the side of the printing medium (16) opposing the piezo printing head (19). The surface to be imprinted is thermally insulated from the preheating area (21) and the after-heating area (22) so it is thermally decoupled from the heating of the preheating area (21) and the after-heating area (22).

10 Claims, 1 Drawing Sheet

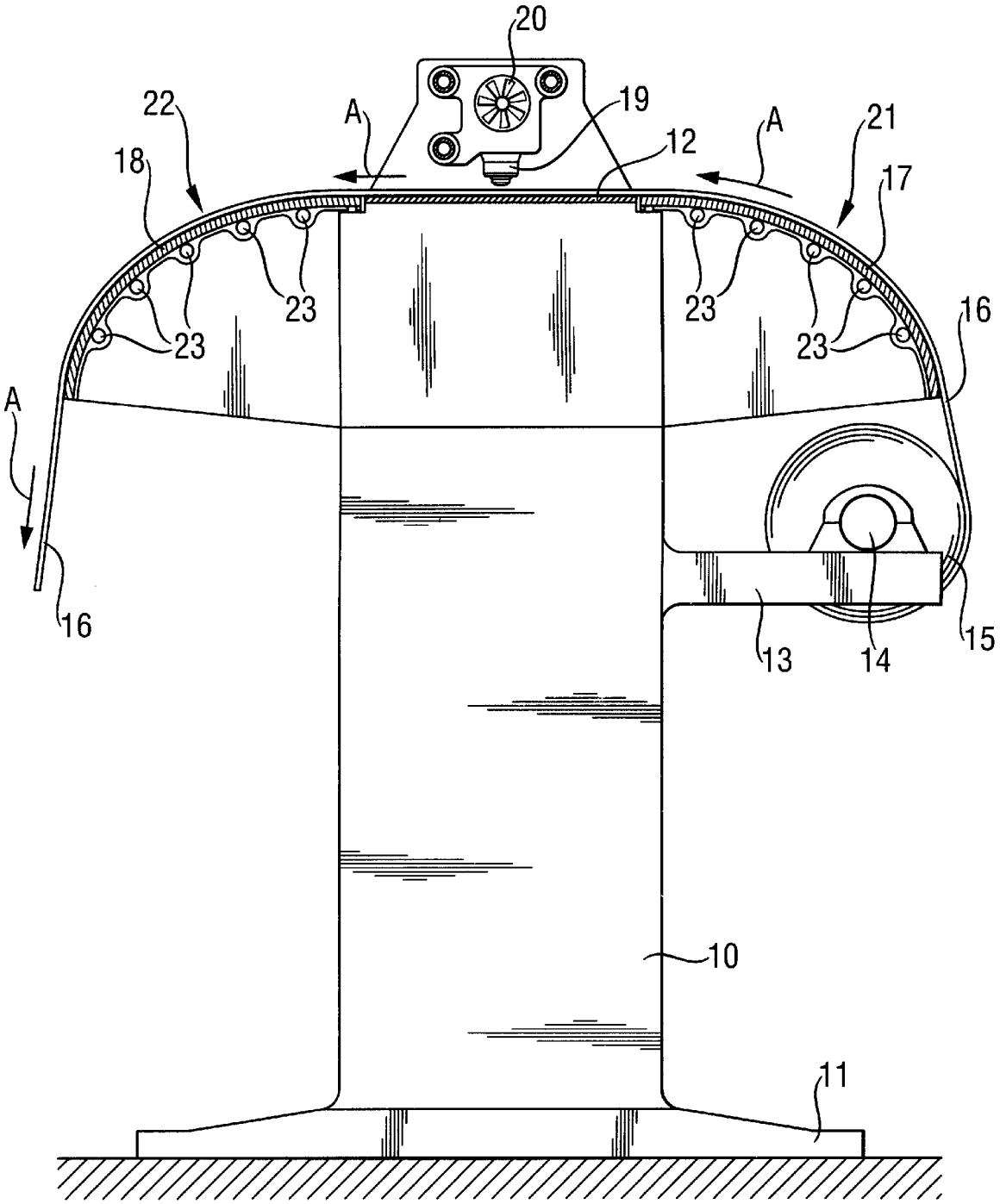
20
19
12
22
A
A
21
18
17
23
23
23
23
16
A
16
13
14
15
10
11

INK JET PRINTER WITH A PIEZO PRINTING HEAD FOR EJECTING LACTATE INK ONTO AN UNCOATED PRINTING MEDIUM

BACKGROUND OF THE INVENTION

1. Field of the Invention

The invention relates to an ink jet printer with a piezo printing head for ejecting lactate ink onto an uncoated printing medium.

2. The Prior Art

The field of ink jet printers, printing heads and inks for such printing heads, as well as of ink jet printing methods, is explained in the following with respect to their suitability for large-format printing products for outdoor applications. The term "printers" comprises in the present case both so-called desk printers and plotters.

Ink jet printers are used for printing primarily on coated materials. The properties of the coating material, also referred to as the top coating, determine the imprintability of the carrier material (or substrate) and the durability (or stability) of the printed image. The coating of the material assures that the ink is absorbed as quickly as possible; that an image with sharp edges is produced; and that such an image is as resistant as possible to environmental influences and light. Furthermore, the printed image has to dry as quickly as possible, and it has to be wipe-proof. Very many different coating materials are available in the market for this purpose. The carrier material (or substrate) itself determines only the mechanical properties of the printing medium in most cases. Commonly used carrier materials for ink jet printers and plotters are papers, foils and Banner materials.

All printing media have in common that the carrier material cannot be imprinted directly because the ink fails to enter into an adequate bond with the carrier material in most cases. The coating of the carrier material with coating material is a cost-intensive process. The refining of the carrier material frequently costs multiple times the cost of the carrier material. Coated printing media are therefore less suitable for large-formatted printed products used in outdoor applications.

Ink jet printers use different printing heads. With ink jet printers equipped with thermo-printing heads, the ink is evaporated or highly expanded by heating it in a capillary, and then sprayed onto the printing medium. This procedure is not suitable for large, UV-stable color pigments. Another drawback is, furthermore, that the thermal stressing of the ink changes the colors. Some components of the ink evaporate before impinging upon the printing medium. The useful life of the printing heads is typically short because they age in a short time due to the thermal stress. Finally, the printing speed is physically limited by the cooling and heating process. Thermo-printing heads are therefore not suitable for imprinting large-format printing products used for outdoor applications.

Thermo-type jet printers with piezo printing heads eject the ink from the capillary by mechanical oscillations of the piezo crystal and spray it onto the printing medium. These printing heads are therefore suited for large, UV-stable color pigments. The colors are not impaired by the printing process. Almost all components of the ink impact the printing medium without evaporation. The ink is processed and applied at the ambient temperature and no extraordinary heating of the ink occurs. The piezo printing heads have a long and useful life. However, the printing speed is limited by the oscillation of the piezo crystal. The printing speeds achieved, however, are nonetheless sufficiently high that a few more droplets of the ink can be shot under the lee of the first droplet. These droplets unite to a large drop (variable drop size) before impacting the material. Piezo printing heads are therefore suitable for large-sized printing products for outdoors applications.

Water-based inks are the type of inks most frequently used with ink jet printers because they can be processed without problems with thermo printing heads. However, these inks can be used only on coated printing media. Because of their low stability, they are suitable for filing purposes only to a limited extent. Their water-solubility renders them unusable for applications in a humid environment mainly outdoors.

Pigmented inks can be considered as another type of ink suitable for ink jet printers, primarily for those equipped with piezo printing heads. Oil-and-water mixtures are frequently used for pigmented inks. However, such mixtures are based on water for the most part, and such inks can be only employed for coated materials. They exhibit good UV-stability and are suitable for medium-term filing purposes. To the extent such inks are water-soluble, they can be considered at best for short-term outdoor applications.

Inks containing solvents have been used for many years in the printing industry, for example for screen printing purposes. Such inks have also been employed on special ink jet or air brush printers. These inks can be used on coated printing media. They possess good UV-stability and they can be stored for a long time. Furthermore, they are not water-soluble. However, such inks require special protective measures as they are being processed because they are highly hazardous to the environment and to health in most cases. Special exhaust measures and the use of active filters are mandated by the government authorities. The disposal of the residual inks poses problems as well. Since such inks have a low flash (or ignition) point they can be transported only as hazardous material. Their storage is critical as well because it is encumbered with government regulations. Quick drying of the inks in the hose system and in the printing heads of the ink jet printer poses additional problems for the use of such inks. The ink system of the printer therefore has to rinsed time and again with solvents, which is very cost-intensive. One switch-on (or start-up) operation may cost up to 100 German marks. Such inks are less suited for producing large-format printing products in the field of outdoors applications.

Furthermore, it is known that lactate inks based on lactic acid ester, which actually belong to the family of the adhesives, can be sprayed with piezo printing heads. In the present case, lactate inks are understood to be inks generally based on lactate, and also inks comprising components with properties similar to the ones of lactate. Such inks offer the advantage that they can be directly sprayed onto uncoated printing media.

They posses good UV-stability and they are suited for use in outdoor applications because they are not soluble in water. Due to their chemical composition, they do not pose any load to the environment. A health hazard exists only if they come into direct contact with the skin or eye. They can be transported and stored without problems. Drying of such inks in the hose system and in the printing heads is relatively uncritical because it can be controlled.

Lactate inks therefore meet the long existing demand for inks that print with ink jet printers on uncoated materials in a manner as simple as possible and friendly to the environment and without health risks because immense manufacturing costs—which have been unavoidable until now—can be saved due to the omission of coating material.

It has been found that when lactate inks are used for conventional ink jet printers and with ink jet printing methods, the quality of the printing is not acceptable because of bleeding phenomena.

An jet ink printer with a printing head for ejecting commonly used printing ink onto a printing medium within the area of a surface to be imprinted is known from WO 00/24 583 A1. A preheating area for preheating the printing medium from the bottom is provided upstream of the surface to be imprinted, and an after-heating area for drying ink applied to the printing medium from below is provided downstream. The preheating and after-heating areas are formed in connection with this known printer by the jacket of a roller, which means that the pre- and after-heating processes are coupled in connection with this known printer. Because of such coupling is not possible to assure the preheating process within the temperature range required for a satisfactory printing result, and the after-drying process will independently thereof take place in the best suitable temperature range.

A similarly structured ink jet printer with pre- and after-heating, which is provided by the jacket of one and the same heatable roller in this case as well, is known from DE 196 11 700 A1.

SUMMARY OF THE INVENTION

It is therefore an object of the invention to provide an ink jet printer that assures high-quality printing products with lactate ink on coating-free printing media.

These and other objects are accomplished by an ink jet printer with a piezo printing head for ejecting lactate ink onto an uncoated printing medium within the area of a surface to be imprinted. There is a pre-heating area (21) for preheating the printing medium is connected upstream of the surface to be imprinted from its side opposing the piezo printing head. The preheating area can be adjusted to a temperature of 24° C. to 50° C. depending on the type of material and thickness and/or the transport speed of the printing medium. There is an after-heating area for drying the lactate ink applied to the printing medium connected downstream of the surface to be imprinted from the side of the printing medium opposing the piezo printing head. The surface to be imprinted is thermally insulated from the preheating area and the after-heating area in such a manner that it is thermally decoupled from the heating of the preheating area and the after-heating area.

Moisture that might still be present is evaporated from the printing medium by the preheating process. The pores of the printing medium, which is preferably present in the form of a PVC sheet, are opened by the feed of heat. This allows the ink, which is based on lactic acid, to deeply penetrate the material. The adhesive behavior of the lactates causes the ink to be literally screwed into the pores.

Correct adjustment of the preheating temperature has a direct influence on whether the ink runs from the material or the colors bleed one into another. Temperatures of preferably 28° C. to 35° C. have been found to be ideal temperature values. However, temperatures of up to 45° C. may be required in connection with thick Banner material depending on the material thickness.

The temperature has to be controlled at about the ideal value with as little variation as possible. If the temperature is too high, the printing medium will corrugate, and the printing head may be blocked and mechanically damaged. If the temperature is too low, the ink runs on the medium, and colors will mix, and the edges will bleed out.

In order to assure that the ink will dry as quickly as possible, the printing medium has to be heated again immediately following the printing process. The sooner the after-heating process for drying the ink will start, the sharper the edges of the printed image will be.

If the after-heating process takes place too early, the printing head is thermally stressed again and it is dried. Furthermore, the printing channel has to be thermally decoupled.

Any possible deformation of the printing medium following the after-heating process is uncritical because the material sacks again after a few centimeters and the corrugations can no longer lead to damage of the printing head.

Temperatures of preferably 40° C. to 45° C. for the after-heating process have been found to be ideal temperature values. However, temperatures of up to 55° C. may be required with thick Banner materials depending on the thickness of the material. Temperatures beyond these values should be avoided, if possible, in order to avoid injury to the user when the heating plate is touched.

Due to the after-heating process, the printed image is dry and wiping-proof 10 to 15 cm downstream of the printing head. There is no risk that the printed product will become blurred if the medium touches the floor because of the printing length. Optionally, there is a take-up (or winding) device.

Normal room temperature conditions have to be assured within the area of the piezo printing head. The area of the surface to be imprinted has to be decoupled from any heating of the printing medium. If the printing head were jointly heated, the ink would cure (or harden) already in the printing head or hose system. Also, the technical properties of the piezo crystals would be changed. No flawless print would be assured in such a case.

The printing stage has to be thermally decoupled from the pre- and after-heating processes for that reason. Additional cooling of the printing head with a ventilator may be necessary in order to avoid undue heating of the printing head.

Because of the slightly different viscosity of the lactate inks and the higher drying risk as compared to commonly employed ink jet inks, a cycle of more frequent cleaning intervals of the heads is required. The printing heads normally drive into a so-called capping station every 1 $m^2$ in order to be cleaned. Cleaning cycles of every 20 to 30 cm have been found to be useful.

The printing medium has to be heated in the pre- and after-heating areas as uniformly as possible over the entire width of the material.

Heating with radiation heat from the top is not useful because this would heat only the material surface of the printing medium. This prevents the moisture from escaping and the pores of the printing medium would not open adequately. Heating has to take place from the bottom and through the printing medium. In this way, the entire material of the printing medium is uniformly heated. This is important in connection with self-adhesive sheets (or foils) consisting of paper backs, adhesive and PVC.

Within the area of the rear and front material feed, most printers have a half-moon-shaped metal plate in order to assure a flawless material transport. This metal plate can be heated directly.

Tests with an infrared heating lamp or heating elements from water boilers have failed because the heating effect is too high and not controllable. Overheating is practically always the consequence. Also, the current consumption of about 1 kW is much too high.

Resistance heating wires with a thermally stable insulation, for example with a Teflon or silicone jacketing, have been found to be ideal. The silicone-jacketed resistance heating wires can be stressed with temperatures of up to 180° C. This means that adequate safety reserves are available with the maximally required 55° C. heating temperature. For the purpose of additional screening, the heating wires are preferably wrapped with a metal mesh and glued into the metal plate from the bottom with adhesive aluminum tape. The wire mesh is connected to the ground conductor. In case of any wire fracture or puncture of the silicone insulation, the house fuse or the fault current protection switch is triggered. This excludes that people might be endangered.

It was found in tests that resistance heating wires with an internal resistance of about 20 ohms per meter of length assure the best results. With a printer width of 140 cm, a heating wire of about 950 cm is secured on the heating plate from the bottom in several lengthwise windings. The current consumption then comes to about 220 watts. The final length of the heating wire depends on the type of printer involved and its construction. Four to six windings were found to be adequate. The metal plate is then heated over a width of about 12 cm and a length of about 140 cm. Due to the lower printing speed (advance) of the ink jet plotters, the printing medium is heated over a time span of from about 20 to 45 seconds. A temperature sensor with electronic control is preferably employed for the control.

Thermal decoupling of the printing stage from the pre- and after-heating areas is achieved with the help of a thermally stable felt or Teflon adhesive tape. In this way, the heated metal plate is prevented from coming into direct contact with the printing stage. Since the metal plate of the housing and the printing stage are made of different materials in most cases, for example steel and aluminum, thermal decoupling thus can be achieved in an easy manner.

Numerous conventional ink jet printers, and mainly ink jet plotters, are suited for being equipped with the preheating and after-heating surface elements as defined by the invention at a later time without any problems, so that such devices can then be operated with the use of lactate ink for producing large-format printing products for outdoor applications on the basis of uncoated printing media by means of piezo printing head or heads.

BRIEF DESCRIPTION OF THE DRAWINGS

Other objects and features of the present invention will become apparent from the following detailed description considered in connection with the accompanying drawing. It is to be understood, however, that the drawing is designed as an illustration only and not as a definition of the limits of the invention.

The single FIGURE of the drawing FIG. 1, shows schematically the cross section of an ink jet plotter.

DETAILED DESCRIPTION OF THE PREFERRED EMBODIMENT

Referring now in detail to the drawing, the FIGURE shows a plotter comprised of a base body 10 supported on a base with a standing foot 11 located at its bottom end. The top end of the base body 10 is designed in the form of a printing stage 12. A support element 13 projects from the base body 10 sideways. This support element supports a supply roll 16 of a printing medium, for example a PVC sheet, which is wound on a core 14. The direction in which the printing medium 16 is transported is indicated in the FIGURE by the arrow A.

A half-moon-shaped, arched feed metal plate 17 is located upstream of the printing stage 12 with respect to the direction in which the printing medium 16 is transported. A similarly shaped discharge metal plate 18 is located downstream of the printing stage 12.

A piezo printing head 19, which is arranged above the printing stage 12 and comprises a cooling in the form of a blower 20, serves for printing the printing medium 16.

According to the invention, the feed metal plate 17 and the discharge metal plate 18, across which the printing medium 16 is transported, can be heated and is thermally insulated from the printing stage 12. The feed metal plate 17 thus fixes a preheating area 21 with respect to the printing stage 12, whereas the discharge metal plate 18 fixes an after-heating area.

So that the metal plates 17 and 18 and thus the printing medium 16 passing over the metal plates can be heated, there are heating devices located below the plates in the form of resisting heating wires. These resistance heating wires are denoted in the FIGURE by the reference numeral 23 only within the zone of the preheating area.

The heating devices are supplied by a control device not shown in such a manner that they precisely assure a defined temperature of the preheating area 21 or the after-heating area 22, notably across the entire width of said areas, and with a uniform distribution across said areas.

By heating the feed metal plate 17, the lactate ink ejected from the printing head 19 is literally screwed into the pores of the printing medium 16 because of its adhesive property, so that the ink is effectively prevented from running on printing medium 16, and the colors are prevented from bleeding one into another.

The after-heating assures that the pressure medium 16 is quickly dried immediately after the printing process, which benefits the sharpness of the edges of the printed image.

Accordingly, while only a few embodiments of the present invention have been shown and described, it is obvious that many changes and modifications may be made thereunto without departing from the spirit and scope of the invention.

What is claimed is:

1. An ink jet printer with a piezo printing head (19) for ejecting lactate ink onto an uncoated printing medium within an area of a surface to be imprinted, comprising a pre-heating area (21) for preheating the printing medium (16) connected upstream from the surface to be imprinted from a side opposing the piezo printing head (10), said preheating area being adjustable to a temperature of 24° C. to 50° C. based on the type of material and thickness and transport speed of the printing medium; and an after-heating area (22) for drying the lactate ink applied to the printing medium (16) connected downstream of the surface to be imprinted from a side of the printing medium (16) opposing the piezo printing head (19), wherein the surface to be imprinted is thermally insulated from the preheating area (21) and the after-heating area (22) so that the surface is thermally decoupled from the heating of the preheating area (21) and the after-heating area (22).

2. The ink jet printer according to claim 1, wherein the preheating area has a temperature of 28° C. to 35° C.

3. The ink jet printer according to claim 1, wherein the after-heating area (22) has a temperature of 35° C. to 60° C.

4. The ink jet printer according to claim 3, wherein the after-heating area (22) has a temperature of 40° C. to 45° C.

5. The ink jet printer according to claim 1, further comprising a cooling device (20) for the piezo printing head (19).

6. The ink jet printer according to claim 1, wherein the preheating area (21) and the after-heating area (2) substantially extend over an entire width of the printing medium (16).

7. The ink jet printer according to claim 1, further comprising a flat heating device below the printing medium for preheating and after-heating the printing medium (16) in the preheating area (21) and the after-heating area (22).

8. The ink jet printer according to claim 7, wherein the heating device is covered at a top side by a metal plate (17, 18) across which the printing medium (16) is passed.

9. The ink jet printer according to claim 7, wherein the heating device comprises resistance heating wires (23) for uniformly heating the metal plate (17, 18) and the printing medium (16).

10. The ink jet printer according to claim 7, wherein the heating device is controlled electronically.

* * * * *